United States Patent [19]

McCullough, Jr. et al.

[11] Patent Number: 4,868,037

[45] Date of Patent: Sep. 19, 1989

[54] INSULATED ARTICLES CONTAINING NON-LINEAR CARBONACEOUS FIBERS

[75] Inventors: Francis P. McCullough, Jr., Lake Jackson; R. Vernon Snelgrove, Damon, both of Tex.

[73] Assignee: The Dow Chemical Company, Midland, Mich.

[21] Appl. No.: 108,662

[22] Filed: Oct. 14, 1987

Related U.S. Application Data

[63] Continuation-in-part of Ser. No. 108,255, Oct. 13, 1987, which is a continuation-in-part of Ser. No. 918,738, Oct. 14, 1986, abandoned.

[51] Int. Cl.[4] ..... D03D 13/00

[52] U.S. Cl. ..... 428/222; 428/288; 428/289; 428/290; 428/367; 428/371; 428/408

[58] Field of Search ..... 428/222, 367, 371, 408, 428/288, 289, 290

[56] References Cited

U.S. PATENT DOCUMENTS

| | | | |
|---|---|---|---|
| 4,412,675 | 11/1983 | Kawakubo | 267/167 |
| 4,631,118 | 12/1986 | McCullough et al. | 204/16 |
| 4,643,932 | 2/1987 | McCullough, Jr. et al. | 428/97 |
| 4,756,941 | 7/1988 | McCullough | 428/97 |

*Primary Examiner*—Marion C. McCamish
*Attorney, Agent, or Firm*—John Lezdey

[57] ABSTRACT

An improved washable insulating article comprising a batting of resilient, elongatable, non-flammable non-linear carbonaceous fibers, said fibers having a reversible deflection ratio of greater than 1.2:1, an aspect ratio greater than 10:1 and an LOI value greater than 40 and the articles of apparel derived therefrom.

30 Claims, 1 Drawing Sheet

INSULATED ARTICLES CONTAINING NON-LINEAR CARBONACEOUS FIBERS

CROSS REFERENCE TO RELATED APPLICATIONS

This application is a continuation-in-part of Application Ser. No. 108,255 filed Oct. 13, 1987, entitled SOUND AND THERMAL INSULATION, by McCullough, et al. which is a continuation-in-part of application Ser. No. 918,738 filed Oct. 14, 1986, entitled THERMAL INSULATION of McCullough, et al. now abandoned, both applications which are incorporated herein by reference.

FIELD OF THE INVENTION

The present invention relates to non-flammable thermal insulation material having a high degree of thermal insulation quality at a low bulk density which also possesses excellent washability and dryability characteristics especially suited for use in insulated articles such as garments or clothing, bedding, sleeping bags, jackets, pants, comforters, pillows and like articles of insulation. More particularly, the invention is concerned with resilient shape reforming lightweight non-flammable insulation structures of carbonaceous materials having low heat conductivity, excellent thermal insulation, excellent washability and low moisture retention. The useful articles containing this insulation structures are further characterized by having good shape and volume retention that are stable to numerous compression and unloading cycles.

BACKGROUND OF THE INVENTION

Advanced thermal personal protection articles which use insulation batting materials will have to meet demands for an acceptable environment. Flammability, smoke toxicity, mold and mildew formation, loss of insulation performance when wet, dust and other irritants are only a short list of the problems found with the current materials used as insulation for personal articles such as garments and sleeping bags.

The prior art has used fowl down and feathers, asbestos, wool, polyester and polypropylene fibers and various foam materials such as polyurethane foam as thermal insulation for many applications. Fowl down is the most desired light weight thermal insulation material. Current thermal protection materials most commonly used as substitutes for down are thermoplastic fibrous materials which provide fair to adequate thermal insulation at some additional weight, but are less than acceptable because they are flammable, melt when subjected to modest amounts of heat and can generate toxic fumes when burned. While asbestos is considered non-flammable, the other aforementioned thermal insulating materials are considered flammable. The bulk densities of some of the well known thermal insulating materials are in the range of 0.35 to 2 pounds per cubic foot (5.6–32.04 kg/m$^3$) for insulating materials useful at temperatures not exceeding 120 degrees C. The aforementioned materials also suffer problems due to moisture retention, ease of wetting, loss of insulation ability when wet and slow drying rates.

U.S. Pat. No. 4,167,604 to William E. Aldrich discloses the use of crimped hollow polyester filaments in a blend with down in the form of a multiple ply carded web which is treated with a thermosetting resin to form a bat having thermal insulating characteristics. The web, however, does not have fireproof characteristics and has low moisture retention properties. In addition, the web's launderability and dryability characteristics are unsatisfactory.

U.S. Pat. No. 4,321,154 to Francois Ledru relates to high temperature thermal insulation material comprising insulating mineral fibers and pyrolytic carbon. To make the insulation light weight, an expanding agent is utilized or hollow particles such as microspheres are utilized. Although light weight, this material does not possess the requisite compressibility, washability and durability to be useful in personal insulation articles such as garments and sleeping bags.

U.S. Pat. No. 4,193,252 to Shepherd, et al. discloses the preparation of partially carbonized, graphite and carbon fibers from rayon which have been knitted into a fabric assembly. When the fabric is deknitted, the partially carbonized and the carbonized fibers contain kinks. The fully carbonized or graphite fibers have kinks which are more permanent in nature. Applicants have found that partially carbonized rayon fibers do not retain their reversible deflection and lose their kinks at relatively low temperatures or under tension. The fully carbonized or graphite yarn which is prepared from rayon to brittle and difficult to handle when deknitting. Moreover, carbon fibers produced from rayon are known to possess high water absorption and lower thermal conductivity than fibers with a higher graphite content, such as fibers prepared from acrylic fibers.

SUMMARY OF THE INVENTION

In accordance with the present invention there is provided an article for insulating a party against the weather and/or temperature wherein the article contains light weight, non-flammable multiplicity of nonlinear carbonaceous fibrous insulation materials which possess both excellent thermal insulation, low moisture retention, good reversible compressibility, and washability. More particularly, the present invention is concerned with an article having a washable insulation comprising a batting, felt or web or resilient shape reforming elongatable non-linear non-flammable carbonaceous fibers having a reversible deflection of at least about 1.2:1, an aspect ratio (1/d) greater than 10:1 and a limited oxygen index value greater than 40.

DESCRIPTION OF THE PREFERRED EMBODIMENTS

The articles of the invention contain insulation material comprising a batting formed from nonlinear nonflammable resilient elongatable carbonaceous fibers having a reversible deflection ratio of greater than about 1.2:1 and an aspect ratio (1/d) of greater than 10:1. The carbonaceous filaments used in the present invention contain at least 65% carbon, are described in copending application Ser. No. 856,305. The carbonaceous fibers may possess a sinusoidal or a coil-like configuration or a more complicated structural combination of the two.

The carbonaceous fibers of this invention, according to the test method of ASTM D 2863-77, have an LOI value of greater than 40. The test method is also known as "oxygen index" or "limited oxygen index" (LOI). With this procedure the concentration of oxygen in $O_2/N_2$ mixtures is determined at which the vertically mounted specimen, when ignited at its upper end, just continues to burn. The size of the specimen is 0.65–0.3 cm with a length from 7 to 15 cm. The LOI value is calculated according to the equation:

$$LOI = \frac{[O_2]}{[O_2] + [N_2]} \times 100$$

The LOI value of a number of fibers is as follows:

| | |
|---|---|
| polypropylene | 17.4 |
| polyethylene | 17.4 |
| polystyrene | 18.1 |
| rayon | 18.6 |
| cotton | 20.1 |
| nylon | 20.1 |
| polycarbonate | 22 |
| rigid polyvinyl chloride | 40 |
| oxidized polyacrylonitrile | greater than 40 |
| graphite | 55 |

Such carbonaceous fibers are prepared by heat treating a suitable stabilized precursor material such as that derived from an assembly of stabilized polyacrylonitrile based materials or pitch based (petroleum or coal tar) or other polymeric materials which can be made into a nonlinear fiber or filament structure or configurations and are thermally stable.

Figure 1:
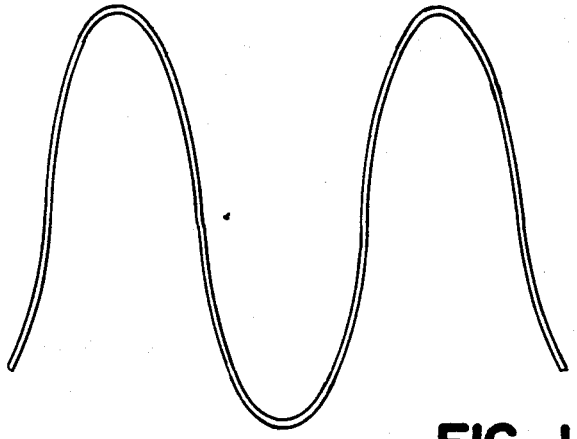
FIG. 1 is a perspective view of a filament of the invention with a sinusoidal configuration.
Figure 2:
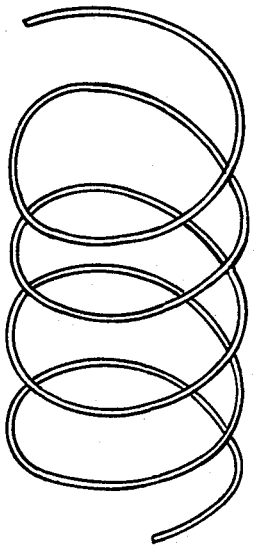
FIG. 2 is a perspective view of a filament of the invention with a coil-like configuration.

For example, in the case of polyacrylonitrile (PAN) based fibers, fibers are formed by melt or wet spinning a suitable fluid of the precursor material having a normal nominal diameter of from about 4 to 25 microns, collected as an assembly of a multiplicity of continuous filaments in tows, are stabilized (by oxidation in the case of PAN based fibers) in the conventional manner, and the stabilized tows (or staple yarn made from chopped or stretch broken fiber staple) are thereafter, in accordance with the present invention, formed into a coil-like and/or sinusoidal form by knitting the tow or yarn into a fabric or cloth (recognizing that other fiber forming and coil forming methods can be employed). The so-formed knitted fabric or cloth is thereafter heat treated, in a relaxed and unstressed condition, at a temperature of from about 525 to about 750 degrees C., in an inert atmosphere for a period of time to produce a heat induced thermoset reaction wherein additional cross-linking and/or a cross-chain cyclization reaction occurs between the original polymer chain. At the lower temperature range of from about 150 to about 525 degrees C., the fibers are provided with a varying proportion of temporary to permanent set while in the upper range of temperatures of from 525 degrees C. and above, the fibers are provided with a permanent set. What is meant by permanently set is that the fibers possess a degree of irreversibility. It is or course to be understood that the fiber or fiber assembly may be initially heat treated at the higher range of temperatures so long as the heat treatment is conducted while the coil-like and/or sinusoidal configuration is in a relaxed or unstressed state and under an inert, non-oxidizing atmosphere. As a result of the higher temperature treatment, a permanently set coil-like (as illustrated in FIG. 2) or sinusoidal (as illustrated in FIG. 1) configuration or structure is imparted to the fibers in yarns, tows or threads. The resulting fibers, tows or yarns having the non-linear structural configuration which are derived by deknitting the cloth, are subjected to other methods of treatment known in the art to create an opening, a procedure in which the yarn, tow or the fibers or filaments of the cloth are separated into a non-linear, entangled, wool-like fluffy material in which the individual fibers retain their coil-like or sinusoidal configuration yielding a fluff or batting-like body of considerable loft.

Figure 3:
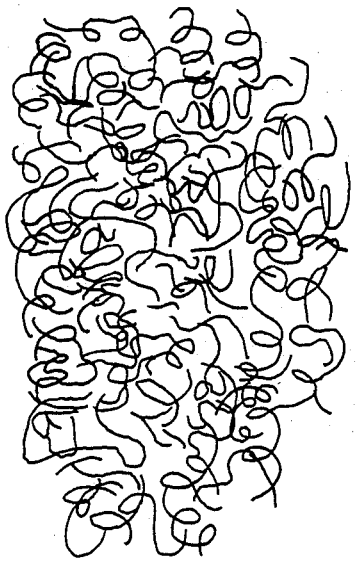
FIG. 3 is an enlarged view of a lightweight nonwoven fibrous mat of the invention.

The fluff or batting of the invention may be utilized alone or may be provided with a suitable barrier layer of flexible sheet or liner material, needle punched, thermally bonded, or thermally quilted with a pinsonic apparatus, depending upon its desired use. The stabilized fibers when permanently configured in accordance with the present invention into the desired structural configuration (as illustrated in FIG. 3), e.g., by knitting, and thereafter heating at a temperature of greater than about 550 degrees C. retain their resilient and reversible deflection characteristics. It is to be understood that higher temperatures may be employed of up to about 1500 degrees C., but the most flexible and smallest loss of fiber breakage, when carded to produce the fluff, is found in those fibers and/or filaments heat treated to a temperature from about 525 and 750 degrees C.

The carbonaceous material which is utilized in the thermal insulating structure of this invention may be classified into three groups depending upon the particular use and the environment that the structures in which they are incorporated are placed.

In a first group, the non-flammable non-linear carbonaceous fibers are non-electrically conductive and the fibrous batting are preferably bound together with thermoset or thermoplastic materials such as epoxy or vinyl ester resins or binder fibers such as polyester, acrylic acid binder fibers and thermally or air cured. These bonded materials are useful for insulation in clothing or sleeping blankets because of their excellent washability, compressibility and resiliency. The fibers may be blended with other synthetic or natural fibers including cotton, wool, polyester, polyolefin, nylon, rayon, and the like.

The term non-conductive as utilized in the present application relates to a resistance of greater than $10^7$ ohms per inch on a 6K tow formed from fibers having a diameter of 7–20 microns. When the precursor fiber is an acrylic fiber, it has been found that a nitrogen content of 18.8% or more results in a nonconductive fiber.

In a second group, the non-flammable non-linear carbonaceous fibers are classified as being antistatic, slightly electrically conductive and having a carbon content of less than 85%. Low conductivity means that the 6K tow with the fibers has a resistance of about $10^7$–$10^4$ ohms per inch. When the precursor stabilized fiber is an acrylic fiber, i.e., a polyacrylonitrile based fiber, the percentage nitrogen content is from about 18 to 18.8% and preferably about 18.5%. These particular fibers are excellent for use as insulation for personal articles where anti-static properties are desirous as well as insulation in areas where public safety is a concern due to their lack of flammability. The structures formed therefrom are lightweight and have low moisture absorbancy, good abrasive strength together with good appearance and handle.

In a third group are the fibers having a carbon content of at least 85%. Preferably, the filaments which are utilized are derived from stabilized acrylic fibers and have a nitrogen content of less than 10%. As a result of the still higher carbon content, the structures prepared are more electrically conductive. That is, the resistance is less than $10^4$ ohms per inch. These fibers can be utilized in place of conventional straight or linear carbon fibers. Moreover, the coillike carbonaceous or carbon filaments when formed into a structure such as a mat or batting, surprisingly provide better insulation against high heat than an equal weight of linear carbon fibers and have a moderate degree of durability, but care must be taken in preparation, fabrication and use due to the inherent shock hazard present. These fibers, as a result of their high carbon content, have superior thermal insulating characteristics. The coil-like structure in the form of a fluff (or when carded) provides an insulation which has good compressibility and resiliency while maintaining improved thermal insulating efficiency and electrical shielding and/or electrical grounding capability.

The precursor stabilized acrylic filaments which are advantageously utilized in preparing the fibers of the structures are selected from the group consisting of acrylonitrile homopolymers, acrylonitrile copolymers and acrylonitrile terpolymers. The copolymers preferably contain at least about 85 mole percent of acrylonitrile units and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers, preferably, wherein the acrylonitrile units are at least about 85 mole percent.

It is to be further understood that carbonaceous precursor starting materials may have imparted to them an electrically conductive property on the order of that of metallic conductors by heating the fiber fluff or the batting like shaped material to a temperature above about 1000 degrees C in a nonoxidizing atmosphere. The electroconductive property may be obtained from selected starting materials such as pitch (petroleum or coal tar), polyacetylene, acrylonitrile based materials, e.g., a polyacrylonitrile copolymer (PANOX or GRAFIL01), polyphenylene, polyvinylidene chloride resin (SARAN, trademark of The Dow Chemical Company) and the like.

Preferred precursor materials are prepared by melt spinning or wet spinning the precursor materials in a known manner to yield a monofilament fiber tow and the fibers or filaments yarn, tow, woven cloth or fabric or knitted cloth by any of a number of commercially available techniques. The materials are then heated to a temperature above about 525 degrees C., preferably to above about 550 degrees C. and thereafter deknitted and carded to produce the fluff which can be laid up in batting-like form.

The fluff of the invention may be treated with an organic or inorganic binder, needle punched, bagged or adhered to a flexible or rigid support using any of the conventional materials and techniques depending upon the use and environment of the structure. The fluff may be placed on one side of a structure such as a furnace or between structural parts either in the form of a mat or batting.

It is understood that all percentages as herein utilized are based on weight percent.

Exemplary of the present invention are set forth in the following examples:

EXAMPLE 1

A stabilized polyacrylonitrile PANOX (R. K. Textiles) continuous 3K or 6K, hereafter referred to as OPF, tow having nominal single fiber diameters of about 12 microns, was knit on a flat bed knitting machine into a cloth having from 3 to 4 loops per centimeter. Portions of this cloth were heat set at one of the temperatures set forth in Table I over a 6 hour period. When the cloth was deknitted, it produced a tow which had an elongation or reversible deflection ratio of greater than 2:1. The deknitted tow was cut into various lengths of from 5 to 25 cm, and fed into a Platts Shirley opener. The fibers of the cut tow were separated by a carding treatment into a wool-like fluff, that is, the resulting product resembled an entangled wool-like mass or fluff in which the fibers had a high interstitial spacing and a high degree of interlocking as a result of the coiled and spring-like configuration of the fibers. The fiber lengths of each such treatment were measured and the results of these measurements set forth in Table 1.

TABLE I

| Run # | Fiber Staple Length (cm) | Heat Treatment degrees C. | Stitches/ cm | Tow Size |
|---|---|---|---|---|
| 1 | 15 | 550 | 4 | 3K |
| 2 | 5 | 550 | 4 | 3K |
| 3 | 10 | 650 | 3 | 6K |
| 4 | 10 | 950 | 3 | 6K |
| 5 | 20 | 750 | 3 | 6K |
| 6 | 25 | 950 | 4 | 6K |

| Run # | Range of Fiber Lengths (cm) | Length of Majority of Fibers (cm) |
|---|---|---|
| 1 | 3.8–15 | 13–15 |
| 2 | 2.5–5 | 2.5–5 |
| 3 | 5.0–10 | 7.5–10 |
| 4 | 3.8–9.5 | 7.5–9.5 |
| 5 | 7.5–19 | 15.0–19 |
| 6 | 7.5–23 | 19.0–23 |

The aspect ratio of each of the fibers was greater than 10:1 and each possessed a LOI value of greater than 40.

EXAMPLE 2

A series of runs were made to determine the effect of various heat treatment temperatures had on the fibers. A significant property was the specific resistivity of the fibers. To determine such property numerous samples of an oxidation stabilized polyacrylonitrile (density 1.35 to 1.39 g/cc) yarn having either 3000 or 6000 filaments per tow, manufactured by R. K. Textiles of Heaton-Norris, Stockport, England, hereafter referred to as Panox 3K or 6K, respectively, was knitted into a plain jersey flat stock having from 3 to 4 stitches per cm, respectively. The cloth was placed under an oxygen-free nitrogen pad in an incremental quartz-tube furnace. The temperature of the furnace was gradually increased from room temperature to about 550 degrees C. over a three-hour period with the higher temperatures being achieved by 50 degrees C. increments every 10–15 minutes. The material was held at the desired temperature for about one hour, the furnace opened and allowed to cool while purging with argon. Representative of the furnace temperatures at the above present incremental temperature schedule is that for a 6K yarn and shown in Table II following:

TABLE II

| Time | Temp. Degrees C. |
|---|---|
| 0720 | 200 |
| 0810 | 270 |
| 0820 | 300 |
| 0830 | 320 |
| 0840 | 340 |
| 0850 | 360 |
| 0900 | 370 |
| 0905 | 380 |
| 0935 | 420 |
| 0950 | 450 |
| 1005 | 500 |
| 1010 | 550 |
| 1025 | 590 |
| 1035 | 650 |
| 1045 | 600 |
| 1100 | 750 |
| 1400 | 750 |

The specific resistivity of the fibers was calculated from measurements made on each sample using a measured average of six measurements, one made from fibers removed at each corner of the sample and one made from fibers removed from each edge, approximately at the middle of the sample. The results are set forth in Table III following:

TABLE III

| Final Temp. in degrees C. | % wt. loss | Log Specific Resistivity Measured in ohm cm |
|---|---|---|
| 500 | — | 4.849 |
| 550 | 33 | — |
| 600 | — | 2.010 |
| 650 | 34 | — |
| 750 | 37 | −1.21 |
| 850 | 38 | −2.02 |
| 900 | 42 | −2.54 |
| 950 | 45 | −2.84 |
| 1000 | 48 | −3.026 |
| 1800 | 51 | −3.295 |

All of the above fibers had cm LOI greater than 40 and an aspect ratio greater than 10:1.

The analysis of the heat treated fibers was as follows:

| Temperature (degrees C.) | % C | % N | % H |
|---|---|---|---|
| ambient (OPF) | 58.1 | 19.6 | 3.8 |
| 450 | 66.8 | 19.4 | 2.2 |
| 550 | 69.9 | 18.9 | 1.9 |
| 650 | 69.7 | 18.1 | 1.6 |
| 750 | 73.0 | 17.8 | 1.1 |

EXAMPLE 3

A fabric was knitted from a 3K or 6K PANOX OPF (R. K. Textiles) continuous stabilized filament tow on a Singer flat bed knitting machine and heat treated at the temperatures until thermoset as set forth in Table IV. The fabric was then deknitted and the spring-like configured tow fed directly into a carding machine. The resulting wool-like mass was collected onto a rotating drum and had sufficient integrity to enable it to be easily handled.

The fiber treated at a temperature of 550 degrees C. is particularly suitable as insulation when bonded with a thermoplastic or thermoset material, for clothing such as parkas, sleeping blankets, etc. because of its hand. As described in Table IV, the length of the fibers ranges from 2 to 15 cm. The woollike mass treated at a temperature of 950 degrees C. was highly conductive and had a resistance of less than 75 ohms at any probe length taken at widely separated distances (up to 60 cm) in the wool-like mass.

The fibers are suitable for use in articles of insulation where static discharge could cause electrical equipment damage or ignite a flammable material in the environment of use.

TABLE IV

| Run # | Fiber Staple Length (cm) | Heat Treatment degrees C. | Stitches/cm |
|---|---|---|---|
| 1 | 7.5 | 550 | 4 |
| 2 | 10 | 650 | 3 |
| 3 | 15 | 650 | 3 |
| 4 | 20 | 950 | 3 |
| 5 | 25 | 950 | 3 |

| Run # | Tow Size | Range of Fibers Lengths (cm) |
|---|---|---|
| 1 | 3K | 2.5–7.5 |
| 2 | 6K | 2.5–10 |
| 3 | 6K | 2.5–13.3 |
| 4 | 6K | 2–15.0 |
| 5 | 6K | 2–12.5 |

The experiment illustrates that the higher temperature heating result in shrinkage of the fibers.

EXAMPLE 4

A 3K (i.e., 3000 filaments) OPF PANOX stabilized tow was knit on a Singer flat bed knitting machine at a rate of 4 stitches/cm an was then heat treated at a temperature of 950 degrees C. The cloth was deknitted and the tow (which had a coil elongation or reversible deflection ratio of greater than 2:1) was cut into 7.5 cm lengths. The cut yarn was then carded on a Platt Miniature carding machine to produce a woollike fluff having fibers ranging from 2.5 to 6.5 cm in length. The woollike fluff had a high electrical conductivity (a resistance less than $10^4$ ohms per inch) over any length of up to 60 cm tested.

In lieu of PANOX, there may be employed stabilized pitch based fibers or a copolymer or terpolymer of polyacrylonitrile.

EXAMPLE 5

In a similar manner to Example 4, a portion from the same knit sock was heat treated at a temperature of 1550 degrees C. The cloth itself and the deknitted tow had a very high electrical conductivity. On carding 15 cm lengths of cut tow, a fluff containing fibers was obtained which had fiber lengths of 2.54 to 9.5 cm (1 to 3 inches) with average lengths of 5 cm (2 inches). Thus, carding of a deknitted continuous filament tow knitted fabric which has been subjected to a temperature of above 1000 degrees C. is still capable of producing a wool-like fluff product.

EXAMPLE 6

The wool-like or fluff material of Example 3 which had been heat treated to 550 degrees C. until thermoset and possessed no electrical conductivity was introduced as filling into a thermal jacket. The jacket employed about 5 ounces (0.14 kg) of the fluff as the sole fill of the jacket. The jacket had an insulating effect similar to that of a down jacket having 15–25 ounces (0.42–0.71 kg) of down as the insulating fill.

EXAMPLES 7 & 8

Two other jackets were filled with the woollike mass of fibers of Example 3. In a first jacket the fibers used were a blend of the fibers of Example 3 and 25% synthetic polyester binder fiber which was thermally bonded to the fibers of Example 3. In a second jacket, the fibers used were the fibers of Example 3 with 20% thermally curable epoxy resin which was thermally cured. Both of the jackets contained less than 15 oz (0.42 kg) of insulation material. The jackets showed no deterioration after several washing, spinning and drying cycles under commercial laundry conditions. The jackets could be tumble dried in accordance with FTM-191-5556 in less than 20 minutes. A similar jacket filled with down or polyester material took at least 50 minutes to dry when subjected to similar drying conditions as the first and second jackets.

EXAMPLE 9

A 3K OPF tow was knit into a sock, the sock treated at 525 degrees C. until it was thermally set and thereafter deknit and cut into about 7 to 7½ inch (17.78–19.05 cm) nominal lengths. The so cut yarns were opened on a Shirley opener then further processed on a Rando Webber machine, an air laying system for producing nonwoven batting. The feed plate-combing rolls were spaced at 12/1000 inch and dispersed into the chamber using a 1200 rpm setting on the fan. A small amount of low melting fibers of polyethylene acrylic acid copolymer (manufactured from PRIMACOR 440 resin produced by The Dow Chemical Company), was blended with the cut treated OPF tow fibers as it was fed into the Shirley. The resulting batting was passed through a Benz hot air oven held at a temperature of 260 degrees C. at a rate of 2 m/min resulting in an oven time of about 1 minute. This was sufficient to melt the polyethylene acrylic acid copolymer to achieve a light bonding of the carbonaceous fibers in the web.

The batting material prepared above was used to fill a comforter. Then comforter showed similar superior washability and dryability characteristics as those described in Examples 7 and 8.

EXAMPLE 10

In a similar manner described in Example 9, the cut fibers were treated in a Shirley opener and then a Rando Webber air laying system, but without the low melting polyethylene acrylic acid copolymer added. The resulting batting was processed on a Hunter Fiber Locker to obtain a mechanical bonding by the needle punching process.

The resulting batting prepared above may be used as insulation material for a thermal glove or mitten, an ear muff or a cold weather boot. EXAMPLE 11

To establish the heat conductivity of the carbon fibers per se, two samples of a fluff prepared in the manner of Example 3, 8×8 inches square (20.32×20.32 cm square) and about 3 inches (7.62 cm) high, one, Sample 1, weighing about 43 grams and the other, Sample 2, about 52 grams were compressed to 1.15 and 0.85 inches (2.92 and 2.16 cm), respectively, and the R-value and the K-value were measured using ASTM-C518 method with a 100 degrees F. (38 degrees C.) hot plate and a 50 degrees F. (10 degrees C.) cold plate. The results were as follows:

| Sample | Compressed Thickness (in.) | R-Value Hr-ft$^2$ degrees F/BTU | K-Value BTU/Hr-ft$^2$-degrees |
|---|---|---|---|
| 1 | 1.15 | 4.11 | 0.28 |
| 2 | 0.85 | 4.03 | 0.21 |

Sample 1 had been heat treated to 950 degrees C. and Sample 2 had been heated to a temperature of 550 degrees C.

EXAMPLE 12

In a similar process as described in Example 11, 6K OPF was knit, heat treated to about 750 degrees C., deknit and the tow cut into 6 inch to 10 inch (15.24 cm to 25.4 cm) lengths, which were passed through a full production size Shirley and collected.

EXAMPLE 13–23

Washing tests were performed on several compartmentalized blankets containing samples of the insulation materials of the present invention. Washing tests were carried out according to FTM 191-5556 (July 20th, 1978) entitled "Mobile Laundry Evaluation for Textile Materials" which is incorporated herein by reference. These examples were carried out using a standard Smith drum as the wash wheel, a standard centrifugal extractor for spinning and a rotary tumble electric dryer for drying. The samples to be washed were placed in compartmentalized nylon blankets with zipper closures on each compartment to facilitate sample loading and removal. The "Cotton Laundering Schedule" described in the above identified test method was followed. The samples tested are listed in the following Table V.

TABLE V

| Sample No. | Sample Description | No. of Washes |
|---|---|---|
| 1 | Shirley Open Fluff coated coated with 25% TACTIX-742(1) Epoxy Resin, thermally cured | 6 |
| 2 | Rando Batting coated with 20% TACTIX-742(1), thermally cured | 7 |
| 3 | Rando Batting coated with 15% TACTIX-742(1), thermally cured | 6 |
| 4 | Rando Batting containing 25% ethylene acrylic acid binder fibers, thermally bonded | 6 |
| 5 | Shirley Open Fluff coated with with 10% solvent carried polycarbonate | 5 |
| 6 | 650 degree Shirley opened DER-532(2) cured, brominated epoxy resin, 20% coating | 5 |
| 7 | 650 degree Shirley open Fluff coated with 30% TACTIX-138(3), cured | 5 |
| 8 | 700 degree Shirley Open Fluff coated with 20% DEN-438(4) Epoxy Resin, cured | 5 |
| 9 | 550 degree Rando Batting non-coated | 5 |
| 10 | 650 degree Shirley opened Fluff coated with 20% DER-736(5) Epoxy Resin, cured | 5 |
| 11 | Rando Batting containing 23% thermally bonded polyester binder fiber | 7 |
| 12 | Rando Batting containing 50% thermally bonded polyester | 7 |

TABLE V-continued

| Sample No. | Sample Description | No. of Washes |
|---|---|---|
| | binder fiber | |

(1)tris-phenoxy phenol-type reson and a Trademark of The Dow Chemical Company.
(2)Trademark of The Dow Chemical Company.
(3)Bis-phenol A resin and a Trademark of The Dow Chemical Company.
(4)Epoxy novolac resin and a Trademark of The Dow Chemical Company.
(5)Alipahtic diepoxide resin and a Trademark of The Dow Chemical Company.

The following observations were made:

1. Samples 1–12 fully recovered original dimensions after 5 to 7 wash-dry cycles.

2. Samples 1–12 were allowed to equilibrate to room temperature, no measurable significant weight loss of the samples was observed.

3. Samples 1–12 required 15 minutes or less total drying time, compared to 55 minutes or greater for down and polyester samples.

4. No significant loss, generally less than 1%, of fiber or binder was observed after 5 to 7 washes of Samples 1–12.

5. Only Sample 10, which contained no binder material, showed a tendency to ball up, but no fiber breakage or loss was observed.

6. Samples 1–12 passed the standard vertical burn test, as cited in FTM 5903 and FAR 25.853B.

7. The work to compress Samples 1–12 is less than 2.75 lb-in with compressional recovery of at least 93%.

8. The absorptive capacity of Samples 1–12 are typically less than 10–20% after 20 minutes of immersion in water and after wringing out.

9. Unlike down, the battings of Samples 1–12 showed no tendency to mildew and showed a good return of insulation characteristics after submersion in water followed by wringing out.

EXAMPLE 24

Nonflammability Test of the Batting

The nonflammability of the batting of the invention has been determined following the test procedure set forth in FAR 25.853(b), which is herewith incorporated by reference. The test was performed as follows:

A minimum of three 1"×6"×6" (2.54 cm ×15.24 cm×15.24 cm) specimens were conditioned by maintaining the specimens in a conditioning room maintained at 70 degrees ±5 degrees F. temperature and 50% ±5% relative humidity for 24 hours preceding the test.

Each specimen was supported vertically and exposed to a Bunsen or Turill burner with a nominal I.D. tube adjusted to give a flame of 1½ inches (3.81 cm,) in height with a calibrated thermocouple pyrometer in the center of the flame indicating a flame temperature of 1550 degrees F. The lower edge of the specimen was ¾ inch (1.91 cm) above the top edge of the burner. The flame was applied to the center line of the lower edge of the specimens for 12 seconds and then removed.

Pursuant to the test, the material was self-extinguishing. The average burn length did not exceed 8 inches (20.32 cm). The average after flame did not exceed 15 seconds and there were no flaming drippings.

Surprisingly, the fibers of the invention all had an LOI of greater than 40.

What is claimed is:

1. In an article for insulating a party against the weather and/or temperature, the improvement which comprises said article having a washable non-flammable insulation comprising a batting, felt or web of resilient shape reforming elongatable non-linear non-flammable carbonaceous fibers, said fibers having a reversible deflection ratio of greater than 1.2:1, an aspect ratio greater than 10:1 and a limited oxygen index value greater than 40.

2. The article of claim 1 wherein said fibers have a sinusoidal configuration.

3. The article of claim 1 wherein said fibers have a coil-like configuration.

4. The article of claim 1 wherein said fibers are non-electrically conductive fibers.

5. The article of claim 4 wherein said fibers possess no anti-static characteristics.

6. The article of claim 5 wherein said insulation has a bulk density of less than about 0.15 lb/ft$^3$.

7. The article of claim 1 wherein said fibers are electrically conductive.

8. The article of claim 1 wherein said fibers have a carbon content of less than 85%.

9. The article of claim 1, wherein said fibers contain a binder.

10. The article of claim 1 wherein said fibers have a carbon content of at least 85%.

11. The article of claim 1 wherein said fibers are derived from stabilized acrylic fibers and said carbonaceous fibers have a percent nitrogen content of from about 18 to about 18.8%.

12. The article of claim 11 wherein said carbonaceous fibers have a nitrogen content of about 20 to 25%.

13. In an article of clothing for insulating a party against the weather and/or temperature the improvement which comprises said article having a non flammable washable insulation comprising a batting, felt or web of resilient shape reforming elongatable non-linear non-flammable carbonaceous fibers, said fibers having a reversible deflection ratio of greater than 1.2:1, an aspect ratio greater than 10:1 and a limited oxygen index value greater than 40 and are non-electrically conductive.

14. The article of claim 13, wherein said insulation has a bulk density of less than about 0.15 lb/ft$^3$.

15. The article of claim 13, wherein said fibers are derived from stabilized polyacrylonitrile.

16. The article of claim 13 wherein said batting comprises coil-like carbonaceous fibers.

17. The article of claim 13 wherein said insulation comprises sinusoidal carbonaceous fibers.

18. In an article of clothing for insulating a party against the weather and/or temperature the improvement which comprises said article having a washable insulation comprising batting, felt or web of resilient shape reforming elongatable non-linear nonflammable carbonaceous fibers, said fibers having a reversible deflection ratio of greater than 1.2:1, an aspect ratio greater than 10:1 and a limited oxygen index value greater than 40 and a carbon content of less than 85%.

19. The article of claim 18 wherein said fibers are derived from stabilized polyacrylonitrile.

20. The article of claim 19 wherein said insulation contains a binder.

21. The article of claim 18 wherein said insulation comprises coil-like carbonaceous fibers.

22. The article of claim 18 wherein said insulation comprises sinusoidal carbonaceous fibers.

23. In an article of clothing for insulating a party against weather and/or temperature the improvement which comprises said article having an insulation comprising a batting, felt or web of resilient electrically conductive shape reforming elongatable non-linear non-flammable carbonaceous fibers, said fibers having a reversible deflection ratio of greater than 1.2:1, an aspect ratio greater than 10:1 and a limited oxygen index value greater than 40 and a carbon content of less than 85%.

24. The article of claim 23 wherein said insulation comprises coil-like carbonaceous fibers.

25. The article of claim 23 wherein said insulation comprises sinusoidal carbonaceous fibers.

26. The article of claim 23 wherein said insulation has a bulk density of less than about 32 $kg/m^3$.

27. In an insulated jacket, the improvement comprising said insulation being composed of a batting, felt or web of resilient shape reforming elongatable non-linear non-flammable carbonaceous fibers, said fibers having a reversible deflection ratio of greater than 1.2:1, an aspect ratio of greater than 10:1 and a limited oxygen index value of greater than 40.

28. In a sleeping bag or blanket having insulation, the improvement comprising said insulation being composed of a batting, felt or web of resilient shape reforming elongatable non-linear non-flammable carbonaceous fibers, said fibers having a reversible deflection ratio of greater than 1.2:1, an aspect ratio of greater than 10:1 and a limited oxygen index value of greater than 40.

29. In an insulated pair of pants, the improvement comprising said insulation being composed of a batting, felt or web of resilient shape reforming elongatable non-linear non-flammable carbonaceous fibers, said fibers having a reversible deflection ratio of greater than 1.2:1, an aspect ratio of greater than 10:1 and a limited oxygen index value of greater than 40.

30. In an insulating glove, mitten or boot the improvement comprising said insulation being composed of a batting, felt or web of resilient shape reforming elongatable non-linear non-flammable carbonaceous fibers, said fibers having a reversible deflection ratio of greater than 1.2:1, an aspect ratio of greater than 10:1 and a limited oxygen index value of greater than 40.

* * * * *